United States Patent [19]

Melissa et al.

[11] 4,401,390

[45] Aug. 30, 1983

[54] RIBBON CONTROL SYSTEM FOR MULTIPLE COLOR IMPACT PRINTER

[75] Inventors: Raymond F. Melissa; Lorne H. Grummett, both of Costa Mesa; Joseph J. Fischer, Santa Ana, all of Calif.

[73] Assignee: Trilog, Inc., Irvine, Calif.

[21] Appl. No.: 201,135

[22] Filed: Oct. 27, 1980

Related U.S. Application Data

[62] Division of Ser. No. 31,076, Apr. 18, 1979, Pat. No. 4,289,069.

[51] Int. Cl.[3] ..... B41J 33/02

[52] U.S. Cl. ..... 400/240.3; 400/403; 400/249

[58] Field of Search ..... 101/93.04, 93.05, 336, 101/93.01, 111, 93.14; 400/240.2, 240.3, 240.4, 249, 121, 124, 140.2

[56] References Cited

U.S. PATENT DOCUMENTS

| | | | |
|---|---|---|---|
| 3,605,610 | 9/1971 | McDorell et al. | 101/93.14 |
| 3,845,709 | 11/1974 | Gardine | 101/111 X |
| 3,880,075 | 4/1975 | Borett et al. | 101/93.14 X |
| 3,991,676 | 11/1976 | Sasaki | 400/240.3 X |
| 4,037,708 | 7/1977 | Walker-Arnott | 400/240.2 X |

FOREIGN PATENT DOCUMENTS

| | | | |
|---|---|---|---|
| 2512259 | 9/1976 | Fed. Rep. of Germany | 400/249 |

OTHER PUBLICATIONS

Skinner et al., IBM Tech. Discl. Bulletin, vol. 21, No. 5, 10/78, pp. 1828-1829.

Gilbreth, IBM Tech. Discl. Bulletin, vol. 15, No. 16, 3/73, pp. 3113-3114.

*Primary Examiner*—Edward M. Coven

*Attorney, Agent, or Firm*—Freilich, Hornbaker, Wasserman, Rosen & Fernandez

[57] ABSTRACT

A printer/plotter system for producing a multiple color hard copy output in response to digital input data. The system includes one or more impact hammers, each capable of printing a single dot with the hammers being arranged to selectively print dots along a defined print line. The system further includes an ink ribbon having multiple zones of different colors carrying encoded identifying indicia. In response to input data defining a dot pattern and the color in which it is to be printed, the ribbon is searched to position the first identified ribbon color zone in front of the impact hammers. After the pattern for that color is printed, the ribbon is again searched and the next identified color zone is moved into print station, i.e. in front of the impact hammers, and the pattern associated therewith is printed. A paper control system is provided to move the paper to be printed upon in a forward direction as information is printed in each color. The paper control system is also operable to move the paper in a reverse direction to reposition the paper for subsequent movement in a forward direction as information is printed in a different color.

6 Claims, 8 Drawing Figures

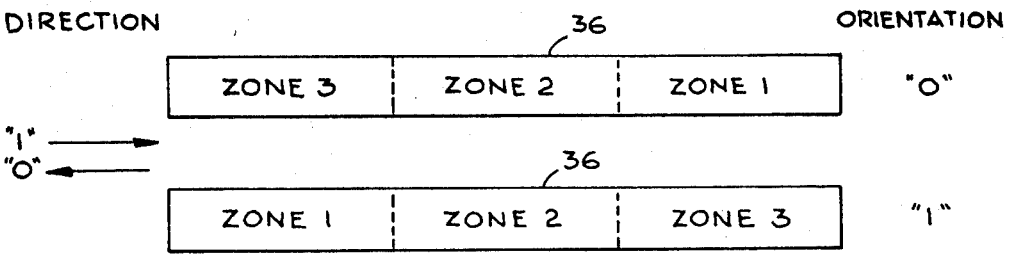
*Fig. 5*
| | (1) COMPARE OUTPUT | (2) DIRECTION | (3) ORIENTATION | (4) BOUNDARY DETECT | (5) ACTION |
|---|---|---|---|---|---|
| (1) | NC = CC | X | X | 0 | ——— |
| (2) | NC = CC | X | X | 1 | REVERSE |
| (3) | NC > CC | 0 | 1 | X | ——— |
| (4) | NC > CC | 1 | 1 | X | REVERSE |
| (5) | NC > CC | 0 | 0 | X | REVERSE |
| (6) | NC > CC | 1 | 0 | X | ——— |
| (7) | NC < CC | 0 | 1 | X | REVERSE |
| (8) | NC < CC | 1 | 1 | X | ——— |
| (9) | NC < CC | 0 | 0 | X | ——— |
| (10) | NC < CC | 1 | 0 | X | REVERSE |
*Fig. 6*
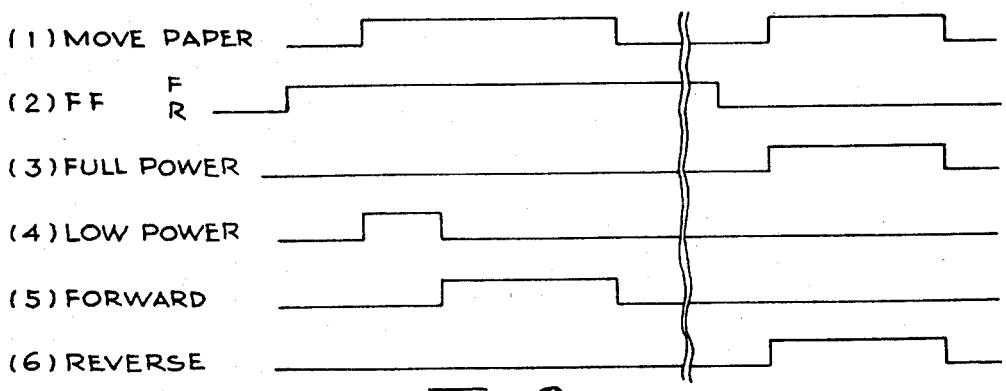
*Fig. 8*

RIBBON CONTROL SYSTEM FOR MULTIPLE COLOR IMPACT PRINTER

This is a division of application Ser. No. 031,076 filed Apr. 18, 1979, now U.S. Pat. No. 4,289,069.

BACKGROUND OF THE INVENTION

This invention relates generally to printers useful for producing hard copy output of electronically represented data supplied, for example, from the central processor unit of a computer system. More particularly, the invention relates to improvements in such printers so as to enable them to selectively print in multiple colors.

The prior art is replete with various printer systems, all suitable for printing text material, comprised of alphanumeric characters, in response to electronically digitally represented data supplied thereto. Moreover, in recent years, printer systems have been developed which are not only capable of printing alphanumeric characters, but which are also capable of plotting (which term herein after shall generally refer to producing hard copy output of arbitrary patterns). One such class of mechanisms which has gained wide acceptance in recent years is known as a "dot matrix impact" printer/plotter. Such devices are capable of selectively operating in either a print mode or a plot mode. A typical dot matrix impact unit is disclosed in U.S. Pat. No. 3,941,051 which is believed to essentially describe a commercially available product marketed by Printronix, Inc., Irvine, California, as the model P300 printer. Similar units are available from other manufacturers and are variously described in the literature.

In a typical dot matrix impact printer, a hammer bank carrying a plurality of individually actuatable hammers is mounted for reciprocating movement along a print line. Each hammer is capable of printing a single dot in each position of the hammer bank but since the bank is mounted for movement along the print line, each hammer can print multiple dots along the line. For example, a typical dot matrix impact printer may use a forty-four hammer bank capable of printing a one hundred thirty two column (character) wide page with each hammer being capable of laying down thirty dots for a total of 1,320 dots across the print line. After each dot line is printed, the paper is moved incrementally and then the next dot line is printed. In high quality dot matrix impact printers, adjacent dots can be overlapped to allow solid lines or areas to be printed. For example, the diameter of each dot can equal 0.020 inches and the center-to-center spacing between dots, both horizontally and vertically can be 0.010 inches. As a consequence of the foregoing, arbitrary dot patterns can be layed down under the control of the input data. Printing or plotting in accordance with the foregoing has typically been performed in only a single color.

BRIEF DESCRIPTION OF THE INVENTION

The present invention is directed to improvements in printer and/or plotter systems which permit printing and/or plotting in multiple colors.

More particularly, the present invention is directed to a method and apparatus for producing a multiple color hard copy output in response to digital input data.

In accordance with the invention, a printer and/or plotter system is provided including at least one dot producer, e.g. an impact hammer. The system includes an ink ribbon having multiple zones of different colors.

Input data supplied to the system identifies a dot pattern to be printed for each different color. In response to the input data, the ribbon is searched to position the first identified ribbon color zone in front of the impact hammers. After the pattern for that color is printed, the ribbon is again searched and the next identified color zone is moved into the print station, i.e. in front of the hammers, and the pattern associated therewith is printed.

In accordance with a preferred embodiment, the different color zones of the ribbon are encoded with identifying indicia and a ribbon control system is provided including means for detecting the direction of ribbon movement as well as the identification of the color zone moving into the print station. The ribbon control system further includes means for selectively positioning the ribbon so that as each color zone is required, it is moved into the print station.

In accordance with a further aspect of the preferred embodiment, a paper control system is provided to move the paper to be printed upon in a forward direction as information is printed in each color. The paper control system is also operable to move the paper in a reverse direction to reposition the paper for subsequent movement in a forward direction as information is printed in a different color.

A system in accordance with the invention is useful not only to print different color characters and areas on a single page but is also extremely valuable for developing useful composites of dot patterns of different colors. For example, in one application, a dot pattern printed in a first primary color can be overprinted with the same dot pattern in a second primary color to thus form that same dot pattern in a third color. Intensity can similarly be varied by overprinting. Alternatively, different dot patterns of different colors can be overlayed to create various shades and effects in the same manner as do conventional halftone images used in other types of printing.

Thus, a system in accordance with the invention is capable of producing a wide range of full color products at a relatively low cost substantially consistent with that of available single color printer/plotter systems.

BRIEF DESCRIPTION OF THE DRAWINGS

A better understanding of the invention may be had by reference to the following description, taken in conjunction with the accompanying drawings, in which:

FIG. 5 is a schematic illustration showing two opposite orientations of a ribbon;

FIG. 6 is a table explaining the operation of the control logic network of FIG. 4;

FIG. 8 is a timing diagram depicting the operation of the paper control system of FIG. 7.

DETAILED DESCRIPTION

Figure 1:
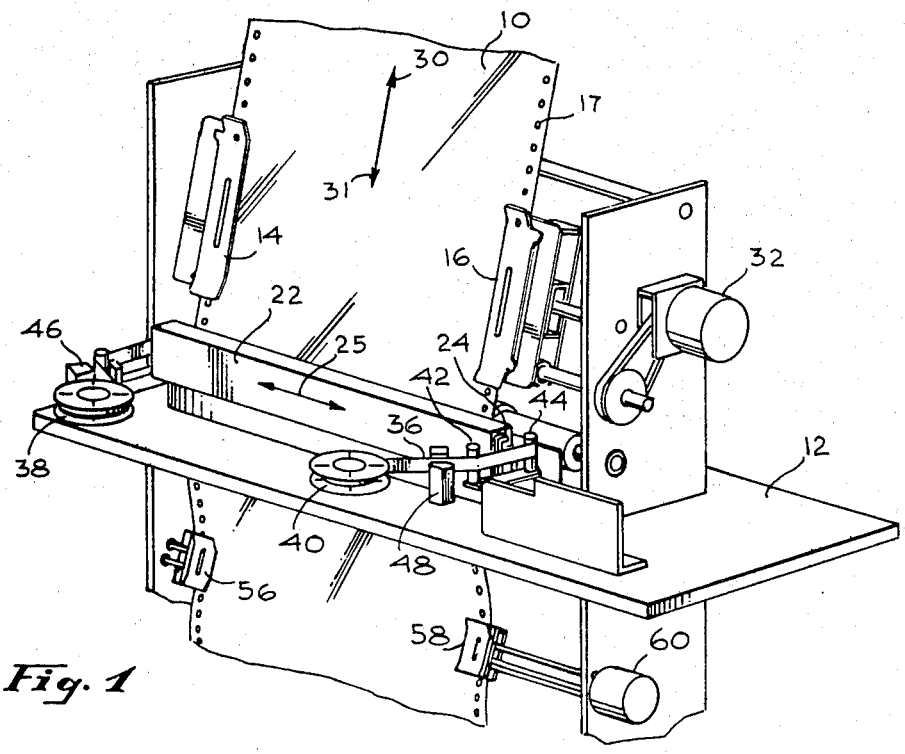
FIG. 1 is a perspective view of a printer/plotter apparatus in accordance with the present invention.

Attention is initially directed to FIG. 1 which illustrates the structure of a printer/plotter incorporating the present invention. It can be noted that the structure illustrated in FIG. 1 is quite similar to the structure illustrated in FIG. 1 of the aforementioned U.S. Pat. No. 3,941,051. For convenience, the present invention will be described primarily in terms of a modification or improvement of the apparatus disclosed in U.S. Pat. No. 3,941,051 and as embodied in the previously mentioned model P300 printer marketed by Printornix, Inc. of Irvine, California. However, it should be understood that the present invention is in no way restricted to that particular structure but rather is applicable to essentially any impact printer.

The apparatus illustrated in FIG. 1 will be assumed to comprise a one hundred thirty two column page printer/plotter intended for use in data processing systems. During printing, the paper web 10 to be printed upon is fed upwardly through base plate 12 and past a horizontal line of print hammers. Although the paper control system will be discussed in greater detail hereinafter, briefly, during printing the paper is advanced by tractor type drives 14, 16, which engage the edge sprocket perforations 17 along the two margins of the paper. A shuttle mechanism 22 is mounted adjacent to the path of paper 10 and carries a plurality of dot hammers 24 which are aligned with one another and spaced along the length of the shuttle 22. The shuttle 22 is mounted for reciprocal movement as represented by the arrow 25. It will be assumed that the shuttle carries a bank of forty-four separate individually actuatable hammers 24. The shuttle control system in the assumed embodiment is capable of moving the shuttle to thirty distinctly defined positions along its path of reciprocal travel. Thus, each of the forty-four hammers 24 is capable of placing up to thirty marks or dots (which are typically, but not necessarily, circular) along a line as the shuttle is moved through one complete cycle. As a consequence, the apparatus is capable of printing up to 1,320 dots along a line extending horizontally across the paper 10. Such a line will hereinafter be referred to as a dot row. It should be appreciated that by selectively controlling the actuations of the hammers 24 as the shuttle 22 moves reciprocally across the paper 10, any different configuration or pattern of dots along the 1,320 dot row can be produced. It will also be assumed that the diameter of each dot equals 0.020 inches and that the dots can be placed with a center-to-center spacing equal to 0.010 inches. This allows adjacent dots to overlap each other by 50% thus permitting solid lines or areas to be printed. Utilization of the aforementioned dimensions permits printing/plotting at a density of 10,000 dots per square inch. Greater or lesser densities could, of course, be utilized but it is preferable that the density be equal to or greater than 2500 dots per square inch for most contemplated applications of the invention.

As will be discussed hereinafter, the apparatus of FIG. 1 is capable of selectively operating in either a print mode in which alphanumeric characters are produced on the paper 10 or in a plot mode in which arbitrary patterns of dots are produced on the paper. As is well known, when operating in the print mode, input data supplied to the apparatus of FIG. 1 defines characters whose shapes or dot patterns have been previously stored as in a read only memory. The definition of a character by the input data accesses that memory and results in information being read therefrom which defines the character dot pattern for multiple dot rows. For example, if characters are being defined by a typical 5×7 matrix, the read only memory would yield the dot pattern for 7 successive dot rows. On the other hand, when operating in the plot mode, the input data must separately define the dot pattern to be produced along each 1,320 dot row. Regardless of the mode of operation, it is, of course, necessary to incrementally move the paper 10 by a dot row spacing after each dot row has been printed to create a two dimensional dot pattern. As has been previously mentioned, paper movement in a forward direction represented by the arrow 30 is effected primarily by the tractors 14, 16 which are driven by stepper motor 32.

In discussing the apparatus of FIG. 1 thus far, it has been assumed that the actuation of a hammer 24 produces a dot on the paper 30. In actuality, the dot is produced by the hammer 24 impacting against an ink ribbon 36 which extends along a path between the hammers 24 and the paper 10. Thus, in operation when a hammer is actuated, it impacts the paper 10 through the ink ribbon 36 thereby printing (i.e. transferring ink) a dot on the paper. The ribbon 36 extends between two spools 38, 40 and around spaced guide pins 42, 44 located adjacent both ends of the path of shuttle 22. The ribbon control system will be discussed at length hereinafter but it will suffice at this point to understand that whenever printing is occurring, the ribbon 36 should preferably be moving from one spool to the other.

It should be understood that the apparatus of FIG. 1 discussed thus far is substantially common to the apparatus disclosed in U.S. Pat. No. 3,941,051 and utilized in commercially available printers such as the previously mentioned Printronix model P300. The present invention is directed to improvements in such printers for enabling multiple color printing. Briefly, multiple color printing in accordance with the invention is accomplished by utilizing a ribbon having multiple zones of different colors and responding to input data commands for positioning the requested ribbon zone within the print station (i.e. between the hammers and paper). Thus, a primary subsystem in accordance with the present invention comprises the ribbon control subsystem which is depicted primarily in FIGS. 3–6 hereof and which will be explained in greater detailed hereinafter. Additionally, in order to minimize ribbon color searching and repositioning, and to permit multiple dot rows, e.g. up to a full page, to be printed in each color, means are provided for moving the paper 10 in a reverse direction represented by the arrow 31. Thus, a second major subsystem in accordance with the present invention comprises the paper control subsystem which is primarily depicted in FIGS. 7 and 8 and which will be described in detail hereinafter.

Briefly, in the operation of a preferred system accordance with the present invention, input data supplied, for example, from a digital computer central processor unit, defines the dot pattern to be produced for each different color component for each different dot row of a page. Depending upon how the input data is formatted, the system may initially print all dots or areas of one color (e.g. blue) on the page. Thereafter, the paper control subsystem reverses the paper movement by a required number of dot rows and the ribbon control subsystem repositions the ribbon to move the green zone, for example, into the print station. Then, the paper control subsystem feeds the paper 10 past the print station one dot row at a time to print the green dot pattern. When the page has been completed, the paper control system then again reverses the paper movement and slews it back the required number of dot rows. The ribbon control subsystem then, for example, moves the red zone into the print station and the paper 10 is moved forward incrementally by dot rows to print the red dot pattern. Thus, arbitrary dot patterns of different colors can be selectively overlayed to create composite effects analogous to those created by conventional half-tone printing techniques. Moreover, patterns or selected dots can actually be overprinted in the same color to increase intensity or in different colors to form a dot which is a mixture of the applied colors.

Figure 2:
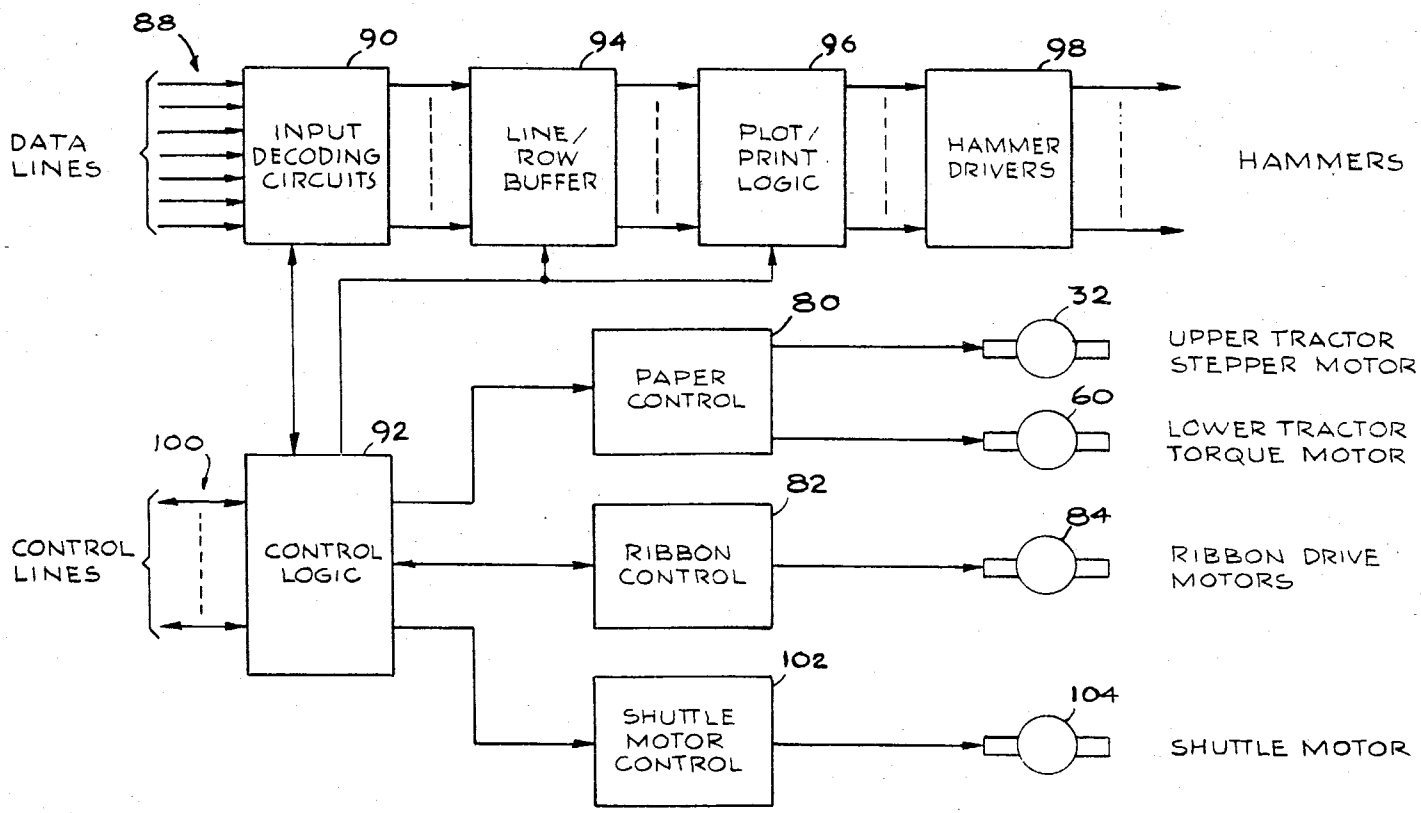
FIG. 2 is a simplified block diagram of an electronic control system for use in conjunction with the apparatus of FIG. 1.

Prior to proceeding to a discussion of FIG. 2, the structural aspects of FIG. 1 which distinguish it from FIG. 1 of previously mentioned U.S. Pat. No. 3,941,051 should be mentioned. The two primary structural changes involve the inclusion of (1) optical sensors 46, 48 respectively located on the base plate 12 proximate to the ribbon spools 38 and 40 and (2) lower tractors 56, 58. As will be discussed hereinafter, the sensors 46, 48 form part of the ribbon control subsystem (FIGS. 3–6) and function to sense coded information (in the form of holes in the disclosed embodiment) carried by the ribbon to define the direction of ribbon movement and the identity of each color zone. The tractors 56 and 58 form part of the paper control subsystem and include sprockets which engage the edge perforations in the paper 10 below the base plate 12. The tractors 56, 58 are driven by a torque motor 60 which is used primarily for slewing the paper 10 in a reverse direction represented by the arrow 31 (FIG. 1). The control of the motor 60 will be discussed in greater detail hereinafter in connection with the description of the paper control subsystem depicted in FIGS. 7 and 8.

Attention is now directed to FIG. 2 which illustrates a block diagram of a printer/plotter apparatus in accordance with the present invention. It is pointed out that the block diagram of FIG. 2 is conventional and substantially equivalent to that shown in U.S. Pat. No. 3,941,051 except for (1) the paper control subsystem 80 for controlling the upper tractor stepper motor 32 and lower tractor torque motor 60 and (2) the ribbon control subsystem 82 for controlling drive motors 84 for driving the ribbon spools 38 and 40 (FIG. 1).

Typically, multiple input data lines 88 are provided for transferring input data from a central processor unit to the input decoding circuits 90 of the printer/plotter apparatus. Although the input data can be formatted in several different manners, for purposes herein a standard ASCII format of seven bit bytes will be assumed. The input data applied to data lines 88 consists of information identifying the dot patterns to be printed as well as control bytes which are used to interpret the dot information and to effect certain operations. For example, the following three control bytes are typically utilized in printer/plotters:

(1) print or plot mode
(2) form feed
(3) line feed

If control byte (1) designates a print mode then the accompanying data bytes are interpreted as character codes and stored dot patterns will be accessed from a character read only memory. If on the other hand a plot mode is defined, then the accompanying data will consist of 1,320 bits for each dot row, each bit identifying whether or not a dot is to be produced in a corresponding position on the paper along that dot row. When in the print mode, a line feed control byte typically means that the paper 10 should be moved in a forward direction a multiple number of dot rows, e.g. 16, in order to get to the next line of text. When in the plot mode, a line feed control byte causes the paper 10 to increment only one dot row. A form feed control byte causes the paper 10 to be moved to the beginning of the next page or form.

The input decoding circuits 90 interpret the input bytes and in the case of control bytes, effect the designated operation by control logic 92. In the case of data bytes, the decoding circuits 90 load a line/row buffer 94 which is typically capable of storing 1,320 bits. These bits are utilized by the plot/print logic block 96 to selectively energize the forty-four hammer drives 98 at the appropriate times. As previously pointed out, the logic 96 will typically interpret the 1,320 bits in the buffer 94 differently depending upon whether a print or plot mode has been defined. In the case of a print mode, the data within the buffer 94 is interpreted as character codes requiring that the previously stored dot patterns be accessed.

A plurality of control lines 100 are also connected to the control logic 92 and these typically interface with the central processor unit and primarily control when information is transferred from the central processor unit to the input decoding circuits. Also connected to the control logic 92 is a shuttle motor control subsystem 102 which controls a shuttle motor 104. These elements are identical to corresponding elements shown in the previously mentioned U.S. Pat. No. 3,941,051 and need not be discussed herein.

In addition to the three previously mentioned control bytes which are common to prior art printer/plotters, the following additional control bytes are defined in order to effect operation in accordance with the present invention:

(4) color select
(5) reverse paper direction
(6) forward paper direction

It is pointed out that the control byte (4) "color select" may indeed comprise two bytes: i.e. a first byte which constitutes a flag identifying that the following byte contains the color zone identification information. For purposes herein it will be assumed that the ribbon has three different color zones which will hereinafter respectively be identified as Z1, Z2, Z3.

Figure 3:
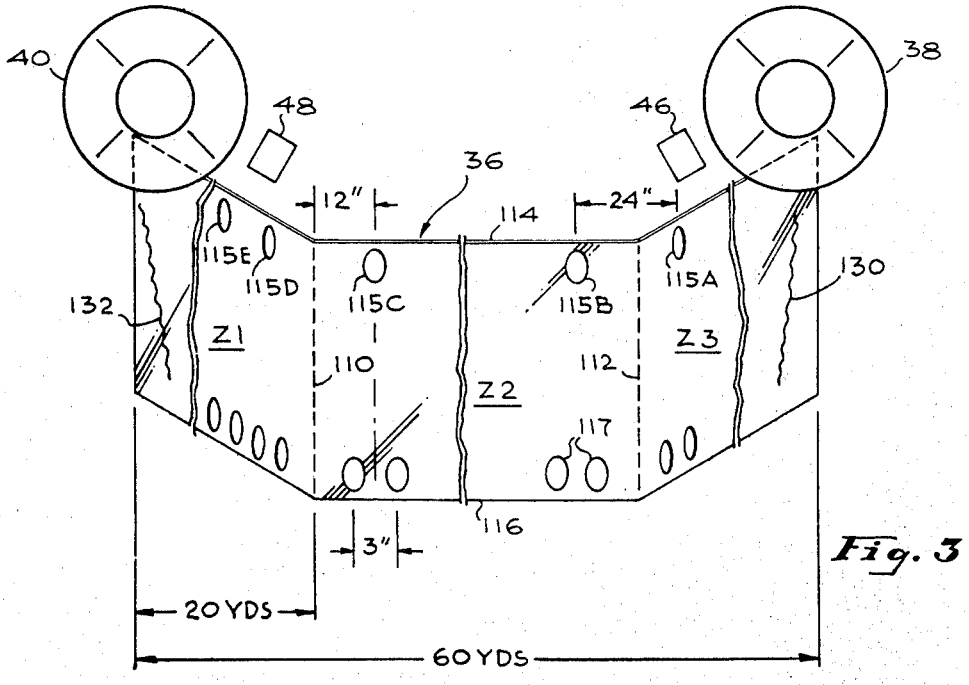
FIG. 3 is a schematic diagram illustrating one manner of encoding a ribbon in accordance with the present invention.

Attention is now directed to FIG. 3 which schematically illustrates a ribbon 36 which has been coded in order to operate in accordance with the present invention. More particularly, FIG. 3 illustrates the ribbon 36 extending between a left spool 40 and a right spool 38. The ribbon is shown as having three zones, respectively Z1, Z2, Z3. Numeral 110 designates the boundary line between zones Z1 and Z2 and numeral 112 designates the boundary line between zones Z2 and Z3.

Typically, the ribbon has a length on the order of sixty yards and it will be assumed herein that each of the three zones has a length of twenty yards. The edges of the ribbon are respectively designated 114 and 116. Holes 115 are formed in the ribbon adjacent to the edge 114 and holes 117 are formed in the ribbon adjacent to the edge 116. The holes are used to yield zone identification information which is sensed by the optical sensors 46, 48 respectively positioned proximate to the spools 38, 40. The coding holes 115 adjacent to edge 114 will be described initially.

More particularly, holes 115 include a hole 115A located in zone Z3 approximately twelve inches to one side of boundary line 112. Hole 115B is located in zone Z2 approximately twelve inches to the other side of boundary line 112. Hole 115C is located in zone Z2 approximately twelve inches to one side of boundary line 110 and a pair of holes 115D and 115E are located in zone Z1. Holes 115D and 115E are respectively located about twelve inches and twenty-four inches from the boundary line 110. The sensors 46, 48 are located approximately fifteen inches apart.

In operation assume initially that the ribbon 36 is entirely wound on spool 38 and is moving to the left, as viewed in FIG. 3. Sensor 46 will initially detect hole 115E and then 115D. Thereafter, sensor 48 will initially detect hole 115E and then hole 115D. As the ribbon continues to move, sensor 46 will thereafter detect hole 115C and subsequently sensor 48 will detect hole 115C. The sequence of detections by sensors, 46, 48 provides direction information as well as distinguishing the boundary line 110 from the boundary line 112. This can readily be seen by now considering that the ribbon has advanced further to the left and boundary line 112 is approaching the sensor 46. Sensor 46 will initially detect hole 115B. Next sensor 48 will detect hole 115B followed by the detection by sensor 46 of 115A and the subsequent detection by sensor 48 of hole 115A.

It should be appreciated that if the ribbon were moving to the right as represented in FIG. 3, i.e. from spool 40 to spool 38, the sensors 46 and 48 would provide a different sequence of detections. It should be recognized that various formats and techniques can be utilized to code the ribbon. For example only, in lieu of holes one could utilize reflective spots, magnetic spots, electrical bridging conductors, etc. Regardless of the particular technique and format utilized, the boundary decoder means 140 (FIG. 4) is provided to respond to the sequence of detections by sensors 46 and 48 to indicate that a boundary has been detected and the identification of that boundary. This aspect will be discussed in greater detail in connection with FIGS. 4–6.

With continuing reference to FIG. 3, it is pointed out that an additional series of holes 117 is formed in the ribbon adjacent to the edge 116. It should be noted that the holes 117 define the same pattern as the previously discussed holes 115 except that for each hole 115, two holes 117 are provided. The purpose of the holes 117 is to convey the same information as was conveyed by the holes 115 but to indicate to the ribbon control subsystem electronics that the ribbon has been oriented in the opposite manner. That is, in order to maximize ribbon wear, it is generally desired to be able to utilize the ribbon in two orientations; that is with either edge 114 or edge 116 uppermost. The provision of coding holes adjacent both edges 114 and 116 permits the ribbon to be used in both orientations. The utilization of two holes 117 in lieu of each hole 115 enables the particular orientation of the ribbon to be determined by the ribbon control subsystem electronics.

With further reference to FIG. 3, it also pointed out that a suitable indicator means, such as a conductive wire 130, 132 sewn into the ribbon 36 is located adjacent each end of the ribbon. When the ribbon is fully rolled onto one spool, the wires 130, 132 bridge the previously mentioned guide pins 42, 44 (FIG. 1) to communicate to the ribbon control subsystem electronics that the end of the ribbon has been reached. The utilization of this information will be discussed in greater detail in connection with FIGS. 4–6.

Figure 4:
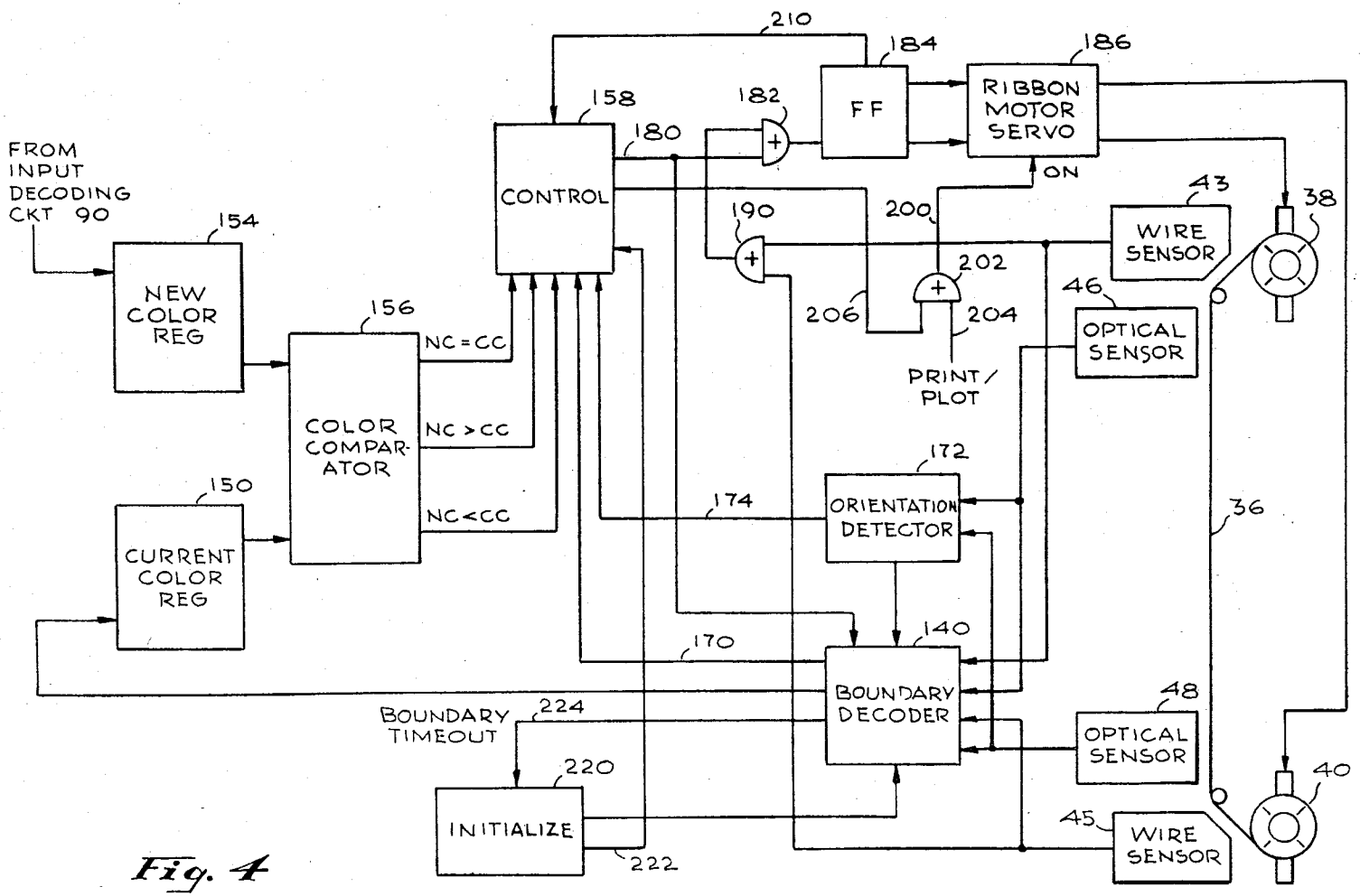
FIG. 4 is a block diagram of a ribbon control system in accordance with the present invention.

Attention is now directed to FIGS. 4–6 which describe the organization and operation of the ribbon control subsystem. FIG. 4 illustrates the ribbon spools 38 and 40 between which extends the ribbon 36, best depicted in FIG. 3. The optical sensors 46 and 48 are respectively positioned proximate to the spools 38 and 40. FIG. 4 further illustrates a pair of wire sensors 43 and 45 respectively positioned adjacent the spools 38 and 40 for detecting the conductive wires 130 and 132 sewn into the ribbon adjacent the ends thereof. It will be recognized that the sensors 43 and 45 are comprised of spaced conductive guide pins such as are illustrated in FIG. 1 at 42, 44. The outputs of the wire sensors 43, 45 and optical sensors 46, 48 are coupled to the input of a boundary decoder circuit 140. The function of the boundary decoder circuit 140 is to determine from the sequence of pulses provided by the sensors when a boundary line 110 or 112 has moved therepast and the identification of the boundary line. The identification of the ribbon color zone currently within the print station is stored within a current color register 150. In the embodiment illustrated in which only three zones are utilized, the register 150 can merely comprise a two stage binary register capable of defining states 1, 2, and 3. In normal operation the boundary decoder circuit 140 will respond to the particular sequence of pulses provided by the sensors to force the state of register 150 to the count (1, 2, 3) corresponding to the zone within the print station.

The ribbon control subsystem of FIG. 4 also includes a new color register 154 which can also comprise a two stage binary register. The register 154 is loaded with a count (1, 2, 3) by the input decoding circuit 190 in response to a previously mentioned color select control byte.

The outputs of registers 150 and 154 are supplied to the input of a color comparator circuit 156 which compares the counts within the two registers. The three possible outputs from the color comparator 156 are as follows:

(1) NC=CC (new color equals current color)
(2) NC>CC
(3) NC<CC

The three outputs of the color comparator 156 are coupled to the input of the ribbon control system control logic network 158. The function of the control logic network 158 is primarily to implement the table shown in FIG. 6. The table of FIG. 6 illustrates in ten lines the various possible sets of input conditions and the actions to be taken with respect to each set of conditions. The table contains five columns, the first four columns illustrating the input conditions and the fifth column illustrating the action to be taken; i.e. to either do nothing or to reverse the direction of ribbon movement.

In order to understand the significance of the table of FIG. 6, initially consider the diagram of FIG. 5. FIG. 5 schematically illustrates the ribbon 36 in both of its orientation which are respectively represented as "0" and "1". Additionally, the two directions of ribbon movement, as shown in FIG. 5 by the arrows, are likewise designated by "0" and "1". It can be seen from FIG. 5 that if the ribbon orientation is "0" and it is moving toward the right (direction "1"), the sequence of ribbon zones moving into the print station is Z1, Z2, Z3. If the ribbon were moving to the left, the zone sequence, of course, would be Z3, Z2, Z1. On the other hand, if the ribbon orientation is "1", then the sequence of zones moving into the print station, for each direction of movement, would be opposite to that for orientation "0".

With the foregoing nomenclature of FIG. 5 in mind, attention is now directed to the table of FIG. 6 which illustrates the operations to be executed by the control logic network 158 (FIG. 4). Line (1) states that if the new color (as represented by the contents of register 154) is equal to the current color (as represented by the contents of register 150), then regardless of the direction or orientation of the tape if no boundary is detected (i.e. "0"), then no action is taken and the ribbon is permitted to continue to move in the direction in which it is moving. On the other hand, as represented in line (2) if the new color equals the current color, then regardless of the direction or orientation, when the passage of a boundary line is recognized by the sensors 46, 48, the direction of ribbon movement must be reversed.

Considering line (3) and with reference to the nomenclature depicted in FIG. 5, if the new color count is greater than the current color count and if the ribbon direction and orientation are respectively "0" and "1", then no action is taken because the desired color zone will be moving into the print station. On the other hand, with the input conditions as depicted in lines (4) and (5) of FIG. 6, the direction of ribbon movement must be reversed in order to position the desired color zone within the print station. With the foregoing in mind, it is assumed that the remaining lines of FIG. 6 will be self-explanatory.

Returning now to the description of FIG. 4, it will be noted that the output of color comparator 156 corresponds to column (1) of the table of FIG. 6. The direction information required for column (2) of FIG. 6 is provided by the state of a flip-flop 184 to be discussed hereinafter. The orientation information required by the control network 158 in accordance with column (3) of FIG. 6 is developed by the orientation detector 172 and communicated to the network 158 via output terminal 174. The orientation detector 172 accepts at its input the outputs of optical sensors 46 and 48. It will be recalled that for one orientation of the ribbon, the sensors 46 and 48 are looking at the holes 115 adjacent to edge 114. For the opposite orientation of the ribbon, the sensors 46 and 48 are looking at the holes 117 adjacent to edge 116. It will also be recalled that whereas single holes 115 are utilized along edge 114, a closely spaced pair of holes (e.g. within three inches) are utilized along edge 116. The orientation detector 172 will recognize the presence or absence of such closely spaced holes and thus represent the orientation (as either "0" or "1") to the logic network 158. It should be mentioned that whereas the orientation detector 172 includes timing circuits to distinguish between a single hole 115 and a pair of closely spaced holes 117, the boundary decoder circuit 140 is timed so as to ignore this distinction. That is, the boundary decoder circuit 140 includes timing circuitry such that when it recognizes a single hole, it will not thereafter for a time equivalent to greater than three inches of the ribbon movement, recognize a further hole. The boundary decoder circuit 140 supplies the boundary detect information of column (4) of FIG. 6 to the control logic network 158.

The network 158 is provided with an output line 180 which is coupled to the input of OR gate 182. Output line 180 provides an enabling signal to the OR gate 182 whenever the input conditions, as represented in FIG. 6 call for a reversal of the ribbon. Thus, an enabling signal provided by the control network 158 on output line 180 changes the state of the direction flip-flop 184. When the flip-flop 184 is true, it will drive the ribbon motor servo system 186 in one direction and when the state of the flip-flop 184 is false, it will drive the ribbon motor servo 186 in an opposite direction. A second input to the OR gate 182 is derived from the output of OR gate 190 which is responsive to the wire sensors 43, 45. OR gate 190 will be enabled whenever the ribbon reaches its end, as manifested by one of the conductive wires 130, 132 being detected by one of the sensors 43, 45. Thus, when gate 190 is enabled, it in turn will enable OR gate 182 and will likewise switch the state of flip-flop 184 to reverse the direction of ribbon movement. The ribbon motor servo 186 is activated by an enabling signal being applied to its control terminal 200 by gate 202. Gate 202 is enabled on input line 204 whenever printing or plotting is taking place. That is, it is intended that the ribbon be moving whenever the hammers are actuated. On the other hand, gate 202 is also enabled by line 206 from the logic network 158 whenever it is seeking a new color zone.

The output of flip-flop 184 is coupled back to the input of the logic network 158 via line 210 to provide the direction information input as required by column (2) of FIG. 6.

The operation of the ribbon control subsystem of FIG. 4 described thus far has assumed normal operation. However, in order for the system to operate when it first comes on, i.e. when power is first applied, a setup or initialize procedure must be first executed. This simply involves moving the ribbon 186 until a boundary line is sensed in order to initialize the various elements of the subsystem. In order to accomplish the setup procedure, the initialize circuit 220 provides a signal on line 222 to the logic network 158. This causes the ribbon motor servo 186 to be driven. When the boundary decoder circuit 140 detects a boundary line, it is communicated to the initialize circuit 220 by line 224. After a predetermined time interval which assures that the coded holes adjacent that boundary line have fully passed the sensors, the initialize circuit 220 forces the logic network 158 to switch the state of flip-flop 184 to thus reverse the direction of ribbon movement. This assures that the boundary decoder 140 will have an opportunity to fully view the coded holes associated with that boundary line and avoid any malfunction if power is first applied, for example, when the coded holes are straddling the sensors.

Figure 7:
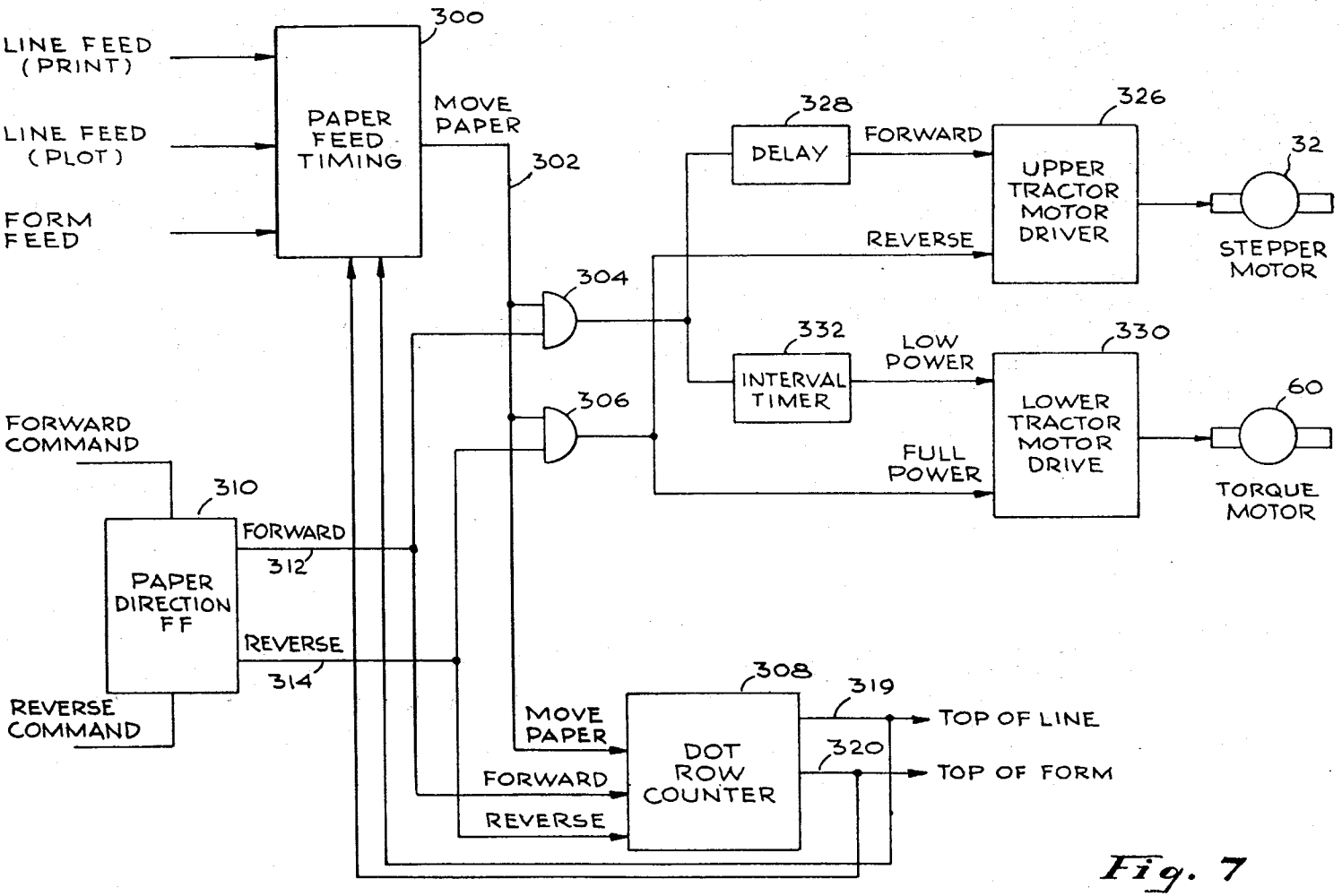
FIG. 7 is a block diagram of a paper control system in accordance with the present invention.

From the foregoing description of the ribbon control subsystem in accordance with FIGS. 3-6, it should now be apparent how the system is able to respond to a color select control byte to move a desired color zone of the ribbon into the print station. As previously pointed out in order to expedite printing and minimize the time spent in repositioning the ribbon, it is preferable to operate a system in accordance with the invention such that the entire pattern for one particular color is printed for a full form or page with the paper then being stepped back an appropriate number of dot rows for subsequent printing in a different color, etc. In order to reverse the paper movement, a paper control subsystem in accordance with the invention is provided as depicted in FIGS. 7 and 8.

The upper tractors 14, 16 of FIG. 1 driven by stepper motor 32 are utilized in a substantially conventional manner in accordance with the present invention. The lower tractors 56, 58 driven by a torque motor 60, preferably a DC motor, are used for two purposes:

(1) for moving the paper downwardly in the direction of arrow 31 (FIG. 1) prior to printing each different color on a form; and (2) to introduce a drag or tension to the paper prior to printing. More particularly, attention is called to the following table which in lines (1)–(4) lists the various paper moving operations:

| | (1) Upper Motor 32 | (2) Lower Motor 60 |
|---|---|---|
| (1) STANDBY | Off | Off |
| (2) PREPAPER MOTION FORWARD | Off | On (low power) |
| (3) PAPER MOTION FORWARD | On (step forward) | Off |
| (4) PAPER MOTION REVERSE | On (step reverse) | On (full power) |

Columns (1) and (2) respectively list the required action of the upper stepper motor 32 and lower torque motor 60. During STANDBY (line (1)), neither motor is operated. During a PREPARER MOTION FORWARD operation (line (2)) the upper stepper motor is not operated but the lower torque motor is operated at low power in a reverse direction to tension the paper. In a PAPER MOTION FORWARD operation (line (3)) the upper motor is stepped forward to incrementally move the paper in the direction of arrow 30 (FIG. 1). The lower motor 60 is not operated. During the PAPER MOTION REVERSE operation (line (4)Z, the upper motor 32 is stepped in reverse and full power is applied to the lower motor 60.

The paper control subsystem includes a paper feed timing circuit 300. The timing circuit 300 is responsive to input commands developed by the decoding circuit 90 (FIG. 2) in response to control bytes supplied on the data lines. Thus, for example, a line feed (print), a line feed (plot), or a form feed command can be supplied to the timing circuit 300. In response, the timing circuit 300 provides an output signal on line 302 to cause the paper to be moved. The line 302 is connected to the input of AND gates 304 and 306 as well as to the input of a dot row counter 308. The paper control subsystem additionally includes a paper direction flip-flop 310 which is responsive to the previously mentioned control bytes "reverse paper direction" (5) and "forward paper direction" (6) input to the decoding circuits 90 on data lines 88 (FIG. 2). Thus, the state of the flip-flop 310 determines whether the paper will be moved in a forward or reverse direction. Flip-flop output terminal 312 goes true when the flip-flop 310 is forced to its FORWARD state. Output terminal 314 goes true when the flip-flop 310 is forced to its REVERSE state. Terminals 312 and 314 are respectively connected to the inputs of gates 304 and 306. Additionally, terminals 312 and 314 are connected to the input of dot row counter 308. Application of a pulse to the dot row counter 308 by the timing circuit 300 on line 302 causes the counter 308 to count. The direction of counting is dependent on which of the flip-flop output terminals 312, 314 is enabled. The dot row counter 308 is capable of defining a number of counts equal to the maximum number of dot rows within a form or page.

The paper feed timing circuit 300 provides an appropiate number of output pulses on line 302 dependent on the control byte applied thereto. For example, a line feed (print) control byte increments the counter 308 until a top of line signal is developed on output terminal 319. Typically, the tops of adjacent print lines are spaced by sixteen dot rows and, therefore, counter 308 yields a top of line signal for one out of sixteen counts. The top of form signal is supplied on counter output terminal 320 once for every 1100 counts in a typical system. The output terminals 319, 320 are coupled back to the input of timing circuit 300 to terminate the pulse sequence being supplied by the timing circuit to the paper drive motors and counter 308. Each line feed (plot) control byte increments the counter 308 by one count and moves the paper drive motors by one dot row.

The output of gate 304 is connected to the FORWARD drive line of the upper tractor motor driver circuit 326 through a time delay circuit 328. Additionally, the output of AND gate 304 is connected to the LOW POWER input terminal of the lower tractor motor driver circuit 330 through an interval timer 332.

The output of AND gate 306 is connected to the REVERSE drive input terminal of the upper tractor motor driver circuit 326 and to the FULL POWER input terminal of the lower tractor motor driver circuit 330. The driver circuits 326 and 330 respectively control the stepper motor 32 and torque motor 60.

FIG. 8 illustrates the paper control subsystem timing. Line (1) represents a MOVE PAPER pulse provided by the timing circuit 300. Line (2) shows the two possible FORWARD and REVERSE states of the flip-flop 310. Line (3) shows that if the paper direction flip-flop 300 defines a FORWARD state, then gate 306 is not enabled and full power is not applied to motor driver circuit 330. However, if the flip-flop 310 defines a REVERSE state, then full power is supplied to the motor driver circuit 330. On the other hand, line (4) demonstrates that if the flip-flop 310 defines a FORWARD state, then the low power input terminal of the motor circuit 330 is energized for a short period defined by the interval timer 332. If the flip-flop 310 defines a REVERSE state, the low power input terminal is not energized. Line (5) shows that the FORWARD input terminal of the motor driver circuit 326 is powered after termination of the low power signal to the motor driver circuit 330. The FORWARD input terminal of the driver circuit 325 is not powered if the flip-flop 310 is in a REVERSE state. Line (6) shows that power is applied to the REVERSE input terminal of motor driver circuit 326 only when the flip-flop 310 defines a REVERSE state.

From the foregoing, it should now be apparent that an impact printer/plotter system has been disclosed herein which is capable of producing hard copy output in multiple colors. Although reference has been made to a specific commercially available printer/plotter system which is described in the literature and depicted in aforementioned U.S. Pat. No. 3,941,051, it should be understood that this has been for convenience only and that the teachings of the invention are equally applicable to various other hardware configurations. Moreover, although the embodiment disclosed has been assumed to use a ribbon having three different color zones, it should be understood that the invention is equally applicable to systems having a greater number of color zones. Similarly, although a particular ribbon zone coding format and technique have been disclosed utilizing holes and optical sensors, it should be readily recognized that alternative forms of coding could be employed. Although it has been assumed in the disclosed embodiment that the paper is moved in a forward direction during printing each color and is slewed in reverse direction prior to changing colors, it should be recognized that printing can be performed during the reverse movement of the paper if desired. Moreover, it should also be understood that the ribbon can be moved at a higher speed during searching that printing.

It is pointed out that although the ribbon has sometimes herein been referred to as an "ink ribbon", it should be understood that this terminology is intended to be generic to any ribbon capable of transferring ink or any other medium to a web for marking. Further, it should also be understood that although particular special purpose control systems have been disclosed herein, it should be understood that other special purpose control system configurations or general purpose microprocessor based control systems could be utilized all in accordance with the present invention.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A control system, useful in a printer apparatus having means for mounting a ribbon for bidirectional movement along a path through a print station, for moving selected zones of the ribbon into said print station, said system comprising:

an elongated ribbon incuding at least first, second, and third contiguous zones of different colors arranged end to end along the length of said ribbon;

a first plurality of binary marks on said ribbon aligned along the direction of ribbon elongation, said marks arranged in uniquely encoded groups, each group being located proximate to a boundary between a different pair of contiguous zones and including at least first and second binary marks spaced by a distance D;

sensor means mounted adjacent to said ribbon path for sensing said binary marks;

said sensor means including first and second sensors fixedly mounted adjacent to said ribbon path, each operable to produce an output signal when one of said binary marks moves therepast, said first and second sensors being aligned and spaced along said ribbon path by a distance different from D whereby all of said marks will move past and be sensed by both said first and second sensors and the sequence of output signals produced by said sensors will indicate the direction of movement of said ribbon; and logic means responsive to said sensor means for identifying the particular ribbon zone in said print station.

2. The system of claim 1 wherein each of said binary marks comprises a hole.

3. The system of claim 1 wherein said ribbon has first and second parallel edges and wherein said first plurality of binary marks are aligned closer to said first edge; and further including a second plurality of binary marks on said ribbon arranged in groups, each group being located proximate to a boundary between a different pair of contiguous zones, said second plurality of binary marks being aligned closer to said second edge.

4. An elongated ribbon useful in printer apparatus having first and second mark sensors mounted in alignment and spaced by a distance S together with means for mounting the ribbon for bidirectional movement along a path through a print station extending past said sensors, said ribbon comprising:

at least first, second, and third contiguous zones of different colors arranged end to end along the length of said ribbon;

a first plurality of binary marks on said ribbon aligned along the direction of ribbon elongation so as to move past said sensors, said marks being arranged in groups, each group being located proximate to a boundary between a different pair of contiguous zones;

each of said groups being uniquely encoded and including at least first and second marks spaced along the length of said ribbon by a distance D different from S whereby said sensors will produce output signals as said marks move therepast to identify the particular ribbon zone in said print station and the direction of ribbon movement.

5. The ribbon of claim 4 wherein said ribbon has first and second parallel edges and wherein said first plurality of binary marks are aligned closer to said first edge; and further including a second plurality of binary marks on said ribbon arranged in groups, each group being located proximate to a boundary between a different pair of contiguous zones, said second plurality of binary marks being aligned closer to said second edge.

6. The ribbon of claim 5 wherein said second plurality of binary marks is arranged identically to said first plurality of binary marks except that said second plurality includes at least two aligned marks spaced closely along the length of said ribbon corresponding to each mark in said first plurality of marks.

* * * * *